United States Patent [19]

Noguchi et al.

[11] Patent Number: 4,480,597

[45] Date of Patent: Nov. 6, 1984

[54] TWO-STROKE CYCLE GASOLINE ENGINE

[75] Inventors: Masaaki Noguchi, Nagoya; Yukiyasu Tanaka; Isao Igarashi, both of Okazaki, all of Japan

[73] Assignee: Toyota Jidosha Kobyo Kabushiki Kaisha, Japan

[21] Appl. No.: 31,739

[22] Filed: Apr. 20, 1979

[51] Int. Cl.[3] ..... F02B 25/08

[52] U.S. Cl. ..... 123/51 BA; 123/51 BD; 123/65 A; 123/70 R; 123/73 AF; 123/73 S; 123/73 AE

[58] Field of Search ..... 123/51 R, 51 B, 51 BA, 123/51 BD, 65 A, 70 R, 73 R, 73 A, 73 AE, 73 AF, 73 S

[56] References Cited

U.S. PATENT DOCUMENTS

| | | | |
|---|---|---|---|
| 2,170,020 | 8/1939 | Gerlach | 123/51 BD |
| 2,195,044 | 3/1940 | Zahren | 123/51 BD |
| 2,347,444 | 4/1944 | Vincent | 123/51 BA |
| 2,844,131 | 7/1958 | Beveridge | 123/51 BA |
| 3,117,566 | 1/1964 | Venediger | 123/65 A |
| 3,916,851 | 11/1975 | Otani | 123/73 R |

FOREIGN PATENT DOCUMENTS

| | | | |
|---|---|---|---|
| 467513 | 6/1914 | France | 123/51 BD |

*Primary Examiner*—Craig R. Feinberg

*Attorney, Agent, or Firm*—Finnegan, Henderson, Farabow, Garrett & Dunner

[57] ABSTRACT

A two-stroke cycle gasoline engine, comprising a power cylinder-piston assembly having a scavenging port configuration including a first scavenging port configuration first uncovered by the power piston as it moves along the power cylinder from its top dead center to its bottom dead center and a second scavenging port configuration uncovered by the power piston as it moves from its top dead center to its bottom dead center immediately after said power piston has completed uncovering the first scavenging port configuration, wherein the general rate relative to piston position in the power cylinder of uncovering of the area of the first scavenging port configuration is substantially lower than that of the second scavenging port configuration, so that the idling and low-load performance of the engine is substantially improved by improving scavenging.

7 Claims, 18 Drawing Figures

TWO-STROKE CYCLE GASOLINE ENGINE

BACKGROUND OF THE INVENTION

The present invention relates to a two-stroke cycle gasoline engine, and, more particularly, to an improvement of idling or low load engine performance of a two-stroke gasoline engine adapted for use with automobiles, when it is operating in a light power output range including idling operation at extremely low output power when compared with standard output power operation.

Ignition rate of fuel-air mixture in idling operation of two-stroke cycle gasoline engines is substantially lower than that of four-stroke cycle gasoline engines, and, because of this, two-stroke cycle gasoline engines have the drawbacks that they generate high noise and vibration and discharge exhaust gases which have high HC content and an offensive odor. When an engine operates in an irregular combustion mode with occasional misfiring and irregular combustion of fuel-air mixture in a cylinder, as a matter of course, the fuel consumption deteriorates. The irregular combustion which occurs in two-stroke cycle gasoline engines is due to insufficient scavenging of the power cylinder, and this is more apt to occur in idling operation in which only a very small amount of scavenging mixture is available.

SUMMARY OF THE INVENTION

It is the object of the present invention to deal with the above-mentioned problems due to insufficient scavenging in idling or low-load operation of two-stroke cycle gasoline engines, and to provide a two-stroke cycle gasoline engine which is improved in this respect.

In accordance with the present invention, the above-mentioned object is accomplished by a two-stroke cycle gasoline engine comprising a power cylinder-piston assembly having a scavenging port configuration including a first scavenging port configuration first uncovered by the power piston as it moves along the power cylinder from its top dead center to its bottom dead center and a second scavenging port configuration uncovered by the power piston as it moves from its top dead center to its bottom dead center immediately after said power piston has completed uncovering the first scavenging port configuration, wherein the general rate relative to piston position in the power cylinder of uncovering of the area of the first scavenging port configuration is substantially lower than that of the second scavenging port configuration.

In accordance with the above-mentioned construction, even in idling or low load operation having a very small delivery ratio, turbulence is generated in the power cylinder by strong jet flows of scavenging mixture delivered through the first scavenging port configuration which blow away combustion gases remaining around the ignition plug, so that ignitability of fuel-air mixture by the ignition plug and flame propagation are improved, thereby improving the combustion speed of the fuel-air mixture and avoiding occurrence of the aforementioned irregular combustion. The above-defined first scavenging port configuration which has a relatively small total opening area does not provide scavenging ports the opening area of which rapidly increases as the power piston traverses them, as in the conventional scavenging ports, but, on the contrary, this opening area increases slowly. Therefore, abrupt decrease of the speed of the jet flow of scavenging mixture delivered through said first scavenging port configuration is avoided as the power piston traverses it, even when the amount of scavenging mixture is relatively small as in idling or low load operation.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
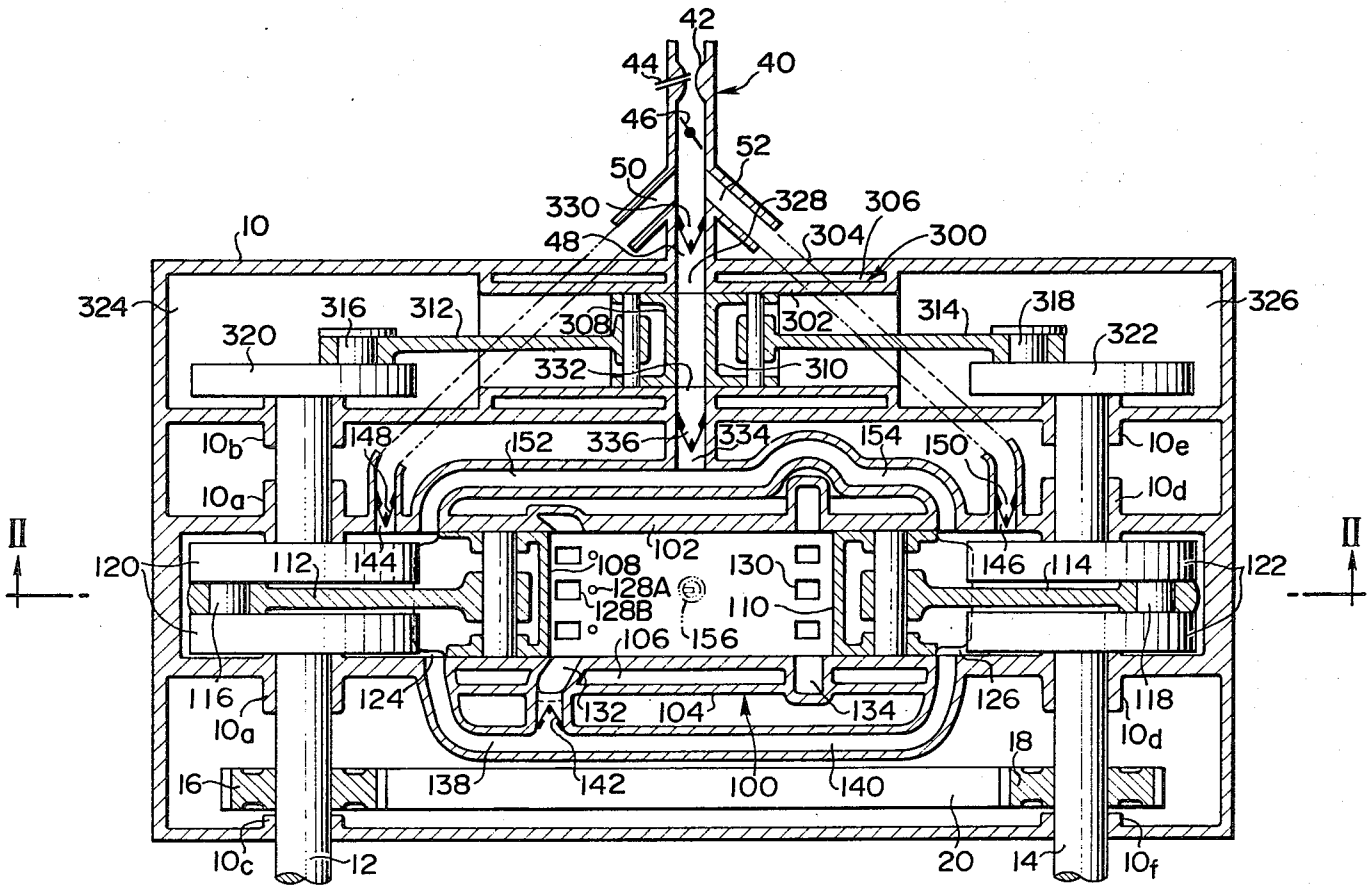
FIG. 1 is a diagrammatical plan sectional view showing an embodiment of the two-stroke cycle gasoline engine of the present invention, which is obtained by incorporating the concept of the present invention in a two-stroke cycle gasoline engine including a two-stroke cycle power cylinder-piston assembly which incorporates uniflow scavenging and two horizontally opposed pistons, proposed in copending patent application Ser. No. 917,244.

Referring to FIGS. 1–4, the two-stroke cycle gasoline engine herein shown comprises a cylinder block 10, the overall shape of which is like a relatively flat block, rectangular in plan view, and adapted to be installed with its two largest faces arranged horizontally. In the cylinder block there are provided a pair of crankshafts 12 and 14 which are arranged along the opposite edges of the cylinder block and are rotatably supported by bearings 10*a*–10*c* and 10*d*–10*f*, respectively. In this embodiment, for example, the crankshaft 12 may be connected to auxiliaries of the engine, while on the other hand the crankshaft 14 may serve as the power output shaft of the engine. In the cylinder block 10 there are incorporated a power cylinder-piston assembly 100 and a scavenging pump means 300, which is in this embodiment an independent pump cylinder-piston assembly having horizontally opposed pistons.

The power cylinder-piston assembly 100 includes a power cylinder 102 supported by the cylinder block 10. The power cylinder is surrounded by a cooling jacket 106 defined by a jacket wall 104. In the cylinder 102 are arranged two power pistons 108 and 110, one being located on the scavenging side or the left side in the figure while the other is located on the exhaust side or the right side in the figure. The pistons 108 and 110 are individually connected with connecting rods 112 and 114, which in turn are individually connected with crankpins 116 and 118, respectively. The crankpins 116 and 118 are individually supported by crank arms 120 and 122, each of which has a disk shape. The two crank mechanisms each including the disk-shaped crank arms and the crank pin are individually housed in crankcases 124 and 126 having a corresponding internal shape so that regardless of rotational angle of the crank the principal internal space of each crankcase is occupied by the crank means so as to reduce the clearance volume of the crankcase to the minimum value.

Figure 3:
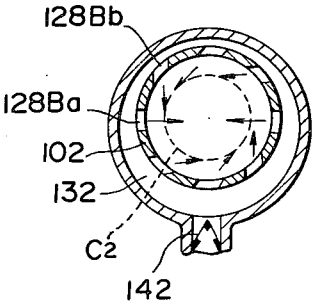
FIGS. 3 and 4 are sectional views along line III—III and IV—IV in FIG. 2, respectively.
Figure 4:
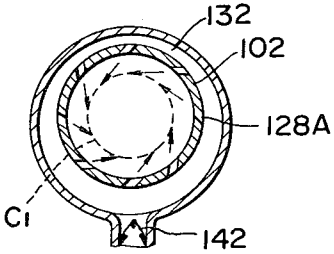

The cylinder 102 has a plurality of first scavenging ports 128A and a plurality of second scavenging ports 128B in its scavenging side. The first scavenging ports 128A have a relatively small total opening area, while the second scavenging ports 128B have a relatively large total opening area and are displaced relative to the first scavenging ports towards the bottom dead center position of the power piston 108. The cylinder 102 has further a plurality of exhaust ports 130 in its exhaust side. The first and second scavenging ports 128A and 128B are all connected with a scavenging plenum 132, while the exhaust ports 130 are connected with an exhaust plenum 134. The exhaust plenum 134 is connected with exhaust pipes 136. As shown in FIG. 4, the first scavenging ports 128A open along axes tangential to a phantom cylinder C1 coaxial with the cylinder 102 and having a diameter smaller than that of the cylinder 102. As shown in FIG. 3, the second scavenging ports 128B include a pair of scavenging ports 128B*a* which open towards the central axis of the power cylinder 102, and six scavenging ports 128B*b* which open along axes tangential to a phantom cylinder C2 coaxial with the cylinder 102 and having a diameter smaller than that of the cylinder 102. Further, the scavenging ports 128A, 128B*a*, and 128B*b* are all inclined towards the exhaust side of the cylinder so that the flows of scavenging mixture discharged from these scavenging ports have a velocity component towards the exhaust ports 130. Thus the scavenging mixture discharged from the scavenging ports 128A and 128B*b* flows through the cylinder 102 towards the exhaust side by forming a spiral flow, whereas the jet flows of scavenging mixture discharged from the pair of scavenging ports 128B*a* collide with each other at the center of the cylinder 102, thereby generating an axial flow of scavenging mixture which scavenges exhaust gases remaining in the central axial portion of the cylinder which have not been scavenged by the aforementioned spiral flow of scavenging mixture. The phantom cylinders C1 and C2 may have the same diameter as one another, or may have different diameters.

An ignition plug 156 is provided at a longitudinally central portion of the power cylinder 102.

The pump 300 includes a pump cylinder 302 supported by the cylinder block 10. The pump cylinder 302 is surrounded by a cooling jacket 306 defined by a jacket wall 304. This cooling jacket serves to remove the compression heat of mixture generated in the pump 300 so as to increase the volumetric efficiency of the pump, while further, when the engine is operated in cold weather, it serves to warm the pump cylinder so as to expedite atomization of the gasoline. For these purposes, the cooling jacket 306 is connected with the cooling jacket 106 of the power cylinder by a passage means not shown in the figure. In the pump cylinder 302 are provided a pair of pump pistons 308 and 310 as opposed to each other. The pistons 308 and 310 are individually connected with connecting rods 312 and 314, which in turn are individually connected with crankpins 316 and 318. The crankpins 316 and 318 are individually supported by crank arms 320 and 322 which, in the shown embodiment, are individually formed as cantilever type crank arms for the purpose of reducing the weight of the engine. The crank mechanisms composed of the connecting rods, crank pins, and crank arms are individually housed in crankcases 324 and 326 which are connected with the internal space of an air cleaner (not shown in the figure) by positive crankcase ventilation valves (also not shown in the figure). The crankshafts 12 and 14 are drivingly connected with each other by way of sprocket wheels 16 and 18 individually mounted on said two crankshafts and an endless chain 20 engaged around the sprocket wheels so that the two crankshafts rotate in the same rotational direction at the same rotational speed. The phase relation between the two crankshafts is so determined that the crankpins 116 and 118 individually related to the power pistons 108 and 110 are shifted from each other by 180°. Depending upon such a phase relation between the crankshafts 12 and 14, the phase relation between the crankpins 316 and 318 individually related to the pump pistons 308 and 310 is so determined that the crankpins are shifted from each other by 180°. Furthermore, the phase relation between the crankpin 116 related to the power piston 108 and the crankpin 316 related to the pump piston 308 and the phase relation between the crankpin 118 related to the power piston 110 and the crankpin 318 related to the pump piston 310 are 180° or approximately 180°. However, it is more desirable to design this phase relation in a manner such that, when the power piston is at its bottom dead center, the pump piston is slightly before its top dead center. The extent of this retardation of the pump piston relative to the power piston is up to about 15°, in consideration of interference which will be caused by the phase difference between compression and intake performed by the pump 300 and the crankcases 124 and 126. By retarding the top dead center of the pump pistons 308 and 310 relative to the bottom dead center of the power pistons 108 and 110 in the aforementioned manner, the scavenging period after the power pistons have passed their bottom dead center, which is not effectively utilized when such a retardation is not provided, can be effectively utilized for continued scavenging.

40 designates a carburetor which includes a venturi portion 42, a main fuel nozzle 44 which opens to the throat portion of the venturi portion, and a throttle valve 46, and takes in air from its air inlet port located upward in the figure and produces fuelair mixture in the usual manner. The mixture outlet port of the carburetor 40 is connected with an inlet port 328 of the pump 300 by way of a passage 48, and is also connected with inlet ports 144 and 146 of the crankcases 124 and 126 by way of passages 50 and 52, respectively. Port 328 is provided with reed valve 330 which allows fluid to flow only towards the pump chamber. Similarly, in ports 144 and 146 are provided reed valves 148 and 150, respectively, each allowing fluid to flow only towards it respective crankcase. An outlet port 332 of the pump 300 is connected with the crankcases 124 and 126 by way of a common passage 334 and branch passages 152 and 154, respectively. In the port 332 or at the middle portion of the passage 334 is provided a reed valve 336 which allows fluid to flow only towards the crankcases.

Figure 2:
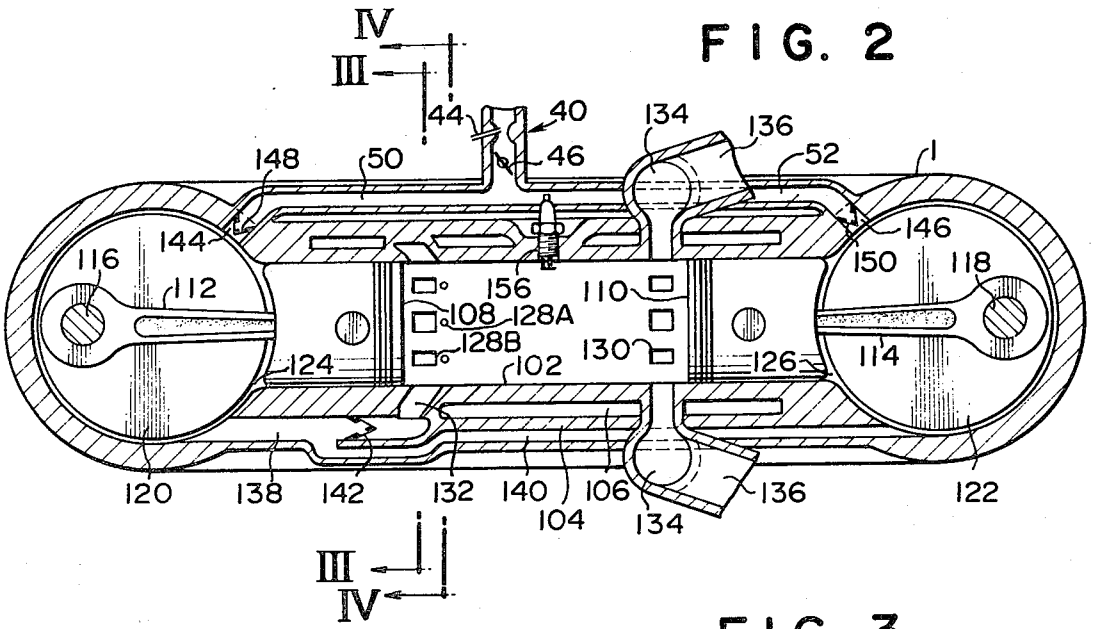
FIG. 2 is a sectional view along line II—II in FIG. 1.

Although in FIG. 1 the carburetor 40, passages 50 and 52, ports 144 and 146, passages 334, 152, and 154, and passages 138 and 140 are shown as developed in a plan view for the convenience of illustration, in the actual engine it is desirable that these means or structures should be three-dimensionally constructed in the following manner. With respect to the passages 138 and 140, it is desirable that these passages open individually between a pair of crank arms 120 and 122 so that the flow of mixture introduced into the crankcase is not obstructed by the crank arm 120 or 122 and the piston 108 or 110. When the engine is in the cold state, liquid fuel accumulates in the bottom of the crankcase. Therefore, it is desirable that the passages 138 and 140 should open to the bottoms of the crankcases so that they can readily take out the accumulated fuel. It is also desirable that the ports 144 and 146 should open between the pair of crank arms 120 and 122 so that the flow of mixture is not obstructed by the arms 120 and 122. When the engine is in the cold state, the carburetor 40 provides poor atomization of fuel, and fuel droplets will be discharged into the passages 48, 50, and 52. Therefore, it is desirable that the carburetor should be located above the pump or the crankcases of the power cylinder-piston assembly so that such fuel droplets can flow into the pump chamber or the crankcases by the action of gravity. Such an arrangement is shown in FIG. 2. Furthermore, as seen in FIG. 1, it is desirable that the power assembly 100 and the pump assembly 300 should be arranged as close to one another as possible. In this connection, therefore, it is desirable that the passages 152 and 154 should be arranged through the clearance left between the power assembly 100 and the pump assembly 300. The ports through which the passages 152 and 154 open individually to the crankcases 124 and 126 may be located so as to oppose the crank arms 120, 122, or the pistons 108, 110, if the ports are adapted so as not to be strongly throttled, because the mixture supplied through the passages 152 and 154 is pressurized by the pump.

In this embodiment the scavenging pump means is composed of the crankcases 124 and 126 of the power assembly and the independent pump assembly 300. In this case, as explained in the copending patent application Ser. No. 917,244, the total stroke volume of such a scavenging pump means is designed to be 1.35–1.85 times as large as the total stroke volume of the power assembly 100. Therefore the stroke volume of the pump assembly 300 is 0.35–0.85 times as large as the total stroke volume of the power assembly.

The operation of the embodiment shown in FIGS. 1–4 will now be described.

When the power pistons 108 and 110 individually move from their bottom dead center (BDC) towards their top dead center (TDC) the pump pistons 308 and 310 move from their TDC towards their BDC. When the pressure difference across the reed valve 330 overcomes the spring force of the reed valve, the pump 300 begins to draw in mixture through the reed valve. Similarly, when the pressure difference across the reed valves 148 and 150 overcomes the spring force of the reed valves, the crankcases 124 and 126 begin to draw in mixture. Thereafter, when the power pistons 108 and 110 move from their TDC towards their BDC, the pump pistons 308 and 310 move from their BDC towards their TDC, whereby the pressure in the crankcases 124 and 126 and the pressure in the pump cylinder 302 increases. In this connection, it is to be noted that, even when the pump pistons 308 and 310 have passed their BDC, the reed valves 330, 148, and 150 are still open for a while, so that, due to the suction inertia effect, suction of mixture is continued during such a period. As the compression by the pump 300 proceeds, since the compression ratio of the pump is higher than that of the crankcases 124 and 126, the mixture compressed by the pump 300 soon pushes open the reed valve 336 so as to flow into the crankcases 124 and 126.

Figure 5:
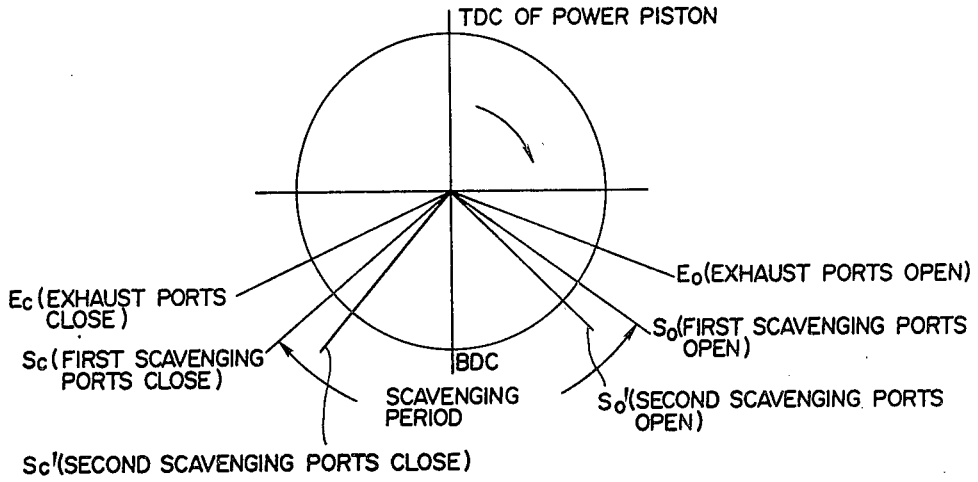
FIG. 5 is a crank angle diagram showing the operational phases of the engine shown in FIGS. 1–4.
Figure 6:
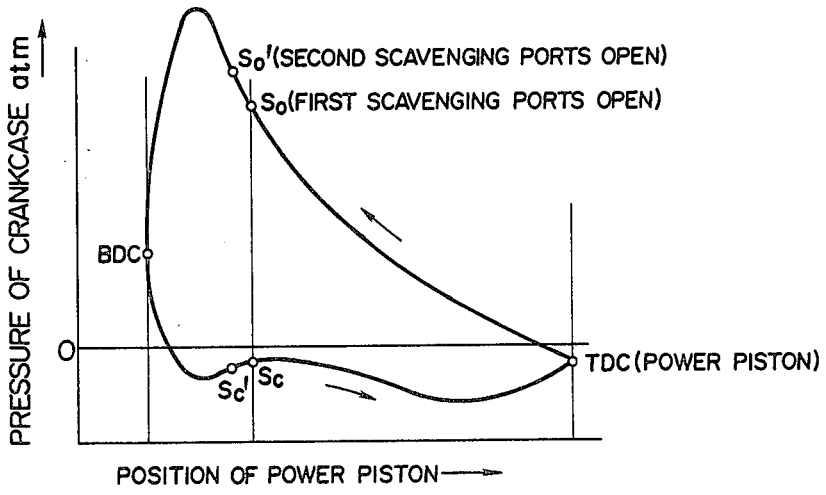
FIGS. 6 and 7 are indicator diagrams showing the crankcase pressure of the engine shown in FIGS. 1–4 in full throttle operating condition and in idling condition, respectively.

As the power pistons 108 and 110 approach their BDC, first the exhaust ports 130 open, (see FIG. 5), whereby the exhaust gases existing in the power cylinder 102 are discharged through the exhaust ports 130 into the exhaust plenum 134, wherefrom they are exhausted through the exhaust pipes 136, and the pressure of the residual exhaust gases existing in the power cylinder 102 rapidly lowers. Then, as the power pistons further proceed towards their BDC, the first scavenging ports 128A and the second scavenging ports 128B are opened in this order, whereby compressed mixture is discharged through these scavenging ports into the power cylinder 102 and flows towards the exhaust ports 130 in the form of a spiral flow while pushing the residual gases existing in the power cylinder out of the exhaust ports. FIG. 6 shows the crankcase pressure in full throttle operation of the engine. Since the amount of scavenging mixture is large in full throttle operation, when the first scavenging ports 128A having a relatively small total opening area are opened, the crankcase pressure is little affected, so that it changes in accordance with movement of the power piston in substantially the same manner as in the engine proposed in the aforementioned co-pending patent application No. 917,244, which incorporates no scavenging ports such as the first scavenging ports 128A.

By contrast, if the engine is idling or operating at low load, and if the engine had only the second scavenging ports 128B as in the engine proposed in the aforementioned co-pending patent application Ser. No. 917,244, since the opening area of the scavenging ports 128B rapidly increases as the power piston traverses them, the scavenging pressure, i.e., the crankcase pressure, would immediately and rapidly decrease as the scavenging ports 128B were opened by the traversing of the power piston, as shown by a broken line in FIG. 7. However, when it is so arranged that the first scavenging ports 128A having a relatively small total opening area are opened prior to the power piston, in its descent towards its BDC, reaching the second scavenging ports 128B (which have the relatively large total opening area which is required in medium through high load operation), as proposed in the present invention, the scavenging pressure or the crankcase pressure is maintained at the pressure level available at the instant when the first scavenging ports 128A are opened, for a certain period, even after these first scavenging ports have been opened, as shown by a solid line in FIG. 7. During this period the strong jet flows of scavenging mixture discharged from the first scavenging ports generate turbulences in the power cylinder which improve ignitability of fuel-air mixture in idling and low load operation of the engine, so as to increase combustion speed of fuel-air mixture, so that the irregular combustion in prior art engines due to poor ignitability and low speed of combustion is effectively avoided. In medium through high speed operation the amount of scavenging mixture is large enough to effect sufficient scavenging and to generate strong turbulences in the power cylinder even when scavenging mixture is discharged from scavenging ports having a relatively large total opening area such as the second scavenging ports 128B, and therefore in this case the first scavenging ports 128A contribute little to improving ignitability and combustion speed of the fuel-air mixture.

Figure 7:
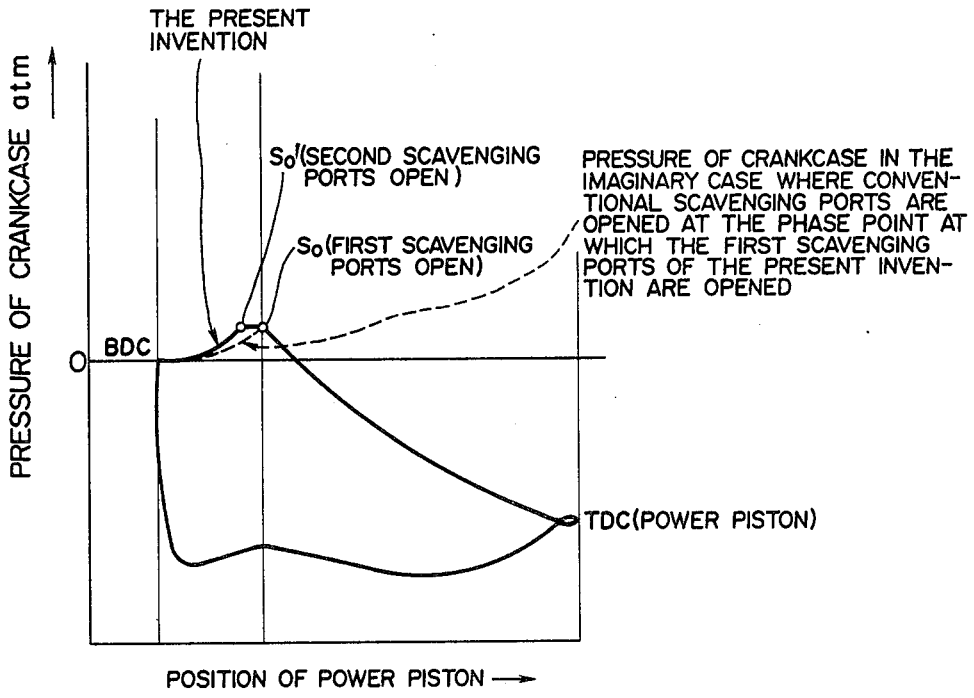

In full throttle operation, as shown in FIG. 6, the crankcase pressure rapidly lowers as the power pistons 108 and 110 approach their BDC. However, even when the power pistons have reached their BDC, a certain level of crankcase pressure remains. By contrast, in idling or low load operation, as shown in FIG. 7, the crankcase pressure is zero when the power pistons have reached their BDC. As the power pistons 108 and 110 move towards their TDC, the scavenging ports 128B and 128A are closed by the power piston 108 on the scavenging side in this order, and then the exhaust ports 130 are closed by the power piston 110 on the exhaust side. After this, the compression of the mixture is initiated. Some time before the power pistons reach their TDC, the compressed mixture is ignited by the ignition plug 156, and the mixture is combusted. After the power pistons have passed their TDC, combustion and expansion stroke is performed and power is produced. Then the exhaust ports 130 are again opened so that the engine completes an operational cycle.

The reed valves 330, 148, and 150 are indispensable for the pump 300 and the crankcases 124 and 126 to perform their compression stroke, while on the other hand the reed valve 336 is not necessarily indispensable. Without this, however, since the pump 300 enters into suction stroke after the power pistons 108 and 110 have passed their BDC, the pressure in the crankcases 124 and 126 will undesirably lower. It is desirable that the reed valves 148 and 150 should be positioned close to the wall of the crankcases so that the clearance volume of the crankcases is reduced.

In view of the fact that the crankcase pressure rapidly lowers after the power pistons have reached their BDC, as shown in FIGS. 6 and 7, it is contemplated that by further retarding the phase of the pump piston relative to that of the power piston by an angle within a range of about 15° in addition to a phase difference of 180°, i.e. by retarding the phase of the pump piston by 180°–195° from the phase of the power piston, the scavenging in the latter half of the scavenging period, i.e. after the power piston has passed its BDC, can be somewhat improved.

Figure 8A:
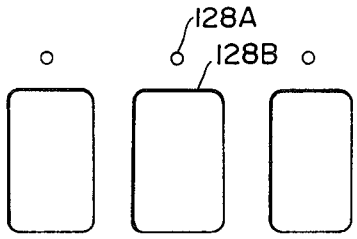
FIGS. 8*a*–8*f* are views showing the contours and arrangement of various embodiments of the scavenging port configuration provided in accordance with the present invention, in plane development at enlarged scale.

FIG. 8*a* shows the contours and arrangement of a first embodiment of the scavenging ports to be incorporated in a two-stroke cycle gasoline engine in accordance with the present invention. This embodiment is the one incorporated in the engine shown in FIGS. 1–4, and includes first scavenging ports 128A, each of which is a small circular opening, and which are opened first as the power pistons 108 moves from its TDC towards its BDC, and second scavenging ports 128B, each of which is a relatively large rectangular opening, and which are opened somewhat later than the first scavenging ports, as the power piston moves from its TDC to its BDC.

Figure 8B:
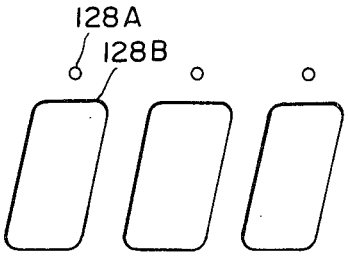

FIG. 8*b* is a view similar to FIG. 8*a*, showing a second embodiment of the scavenging ports, which is a small modification of the embodiment shown in FIG. 8*a*. In this case the second scavenging ports 128B are formed to have side edges which are inclined relative to the generators of the power cylinder 102. By the side edges of the scavenging ports 128B being inclined relative to these generators, it is avoided that a particular portion of the power piston (in fact, the piston rings provided around the piston) repetitively should engage a side edge of a scavenging port so as to cause local heavy wearing in the piston.

Figure 8C:
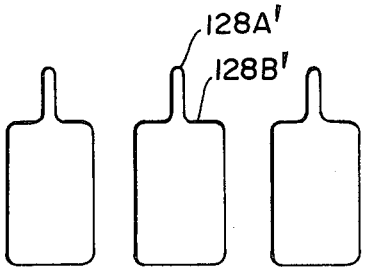

FIG. 8*c* shows a third embodiment of the scavenging ports, in the same manner as FIG. 8*a* or 8*b*. In this embodiment the first scavenging ports 128A and the second scavenging ports 128B in the embodiment shown in FIGS. 8*a* and 8*b* are connected with each other so as to provide a continuous edge. In this case, therefore, first scavenging port portions 128A' which have a relatively small total opening area are opened first as the power piston 108 moves from its TDC towards its BDC, and second scavenging port pistons 128B' which have a relatively large total opening area are opened later as the power piston 108 moves from its TDC to its BDC.

Figure 8D:
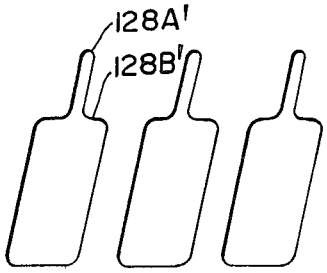

FIG. 8*d* shows a fourth embodiment of the scavenging ports, which is a small modification of the embodiment shown in FIG. 8*c*. In this embodiment the side edges of the first and second connected scavenging port portions 128A' and 128B' are all inclined to the generators of the power cylinder 102.

Figure 8E:
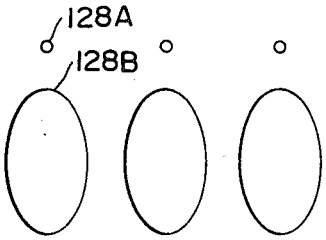

FIG. 8*e* shows a fifth embodiment of the scavenging ports in the same manner as the preceding figures. In this embodiment the second scavenging ports 128B have elliptical contours. In this case it will be appreciated that, without inclining the longer axis of the ellipses relative to the generators of the power cylinder 102, the effect of avoiding a partial heavy wearing of the power piston is obtained, as in the embodiments of FIGS. 8*b* and 8*d* above.

Figure 8F:
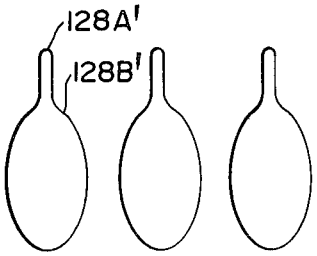

FIG. 8*f* shows a modification of the embodiment shown in FIG. 8*e*, wherein the first and second scavenging ports 128A and 128B are replaced by combined first and second scavenging port portions 128A' and 128B', as in the embodiments of FIGS. 8*c* and 8*d*.

By employing the scavenging ports shown in FIGS. 8*a*, 8*b*, and 8*e*, which have separate first and second scavenging ports 128A and 128B, stable jet flows of scavenging mixture of substantially constant size are maintained for a certain period after the first scavenging ports 128A have been opened, so that a strong swirl flow is generated in the power cylinder which improves ignition and combustion of fuel-air mixture, particularly in idling and low load operation. On the other hand, when the port structures shown in FIGS. 8*c*, 8*d*, and 8*f* having continuous first and second scavenging port portions 128A' and 128B' are employed, the jet flows of scavenging mixture discharged from the scavenging ports change so as to increase their size progressively, whereby stronger turbulences are generated in the power cylinder, which are also effective to improve ignition and combustion of fuel-air mixture in the power cylinder, particularly in idling and low load operation of the engine. Depending on circumstances, one or the other configuration may be preferable.

The scavenging port portions 128A' have an advantage, in that they are less liable to clogging than the scavenging ports 128A.

Figure 9:
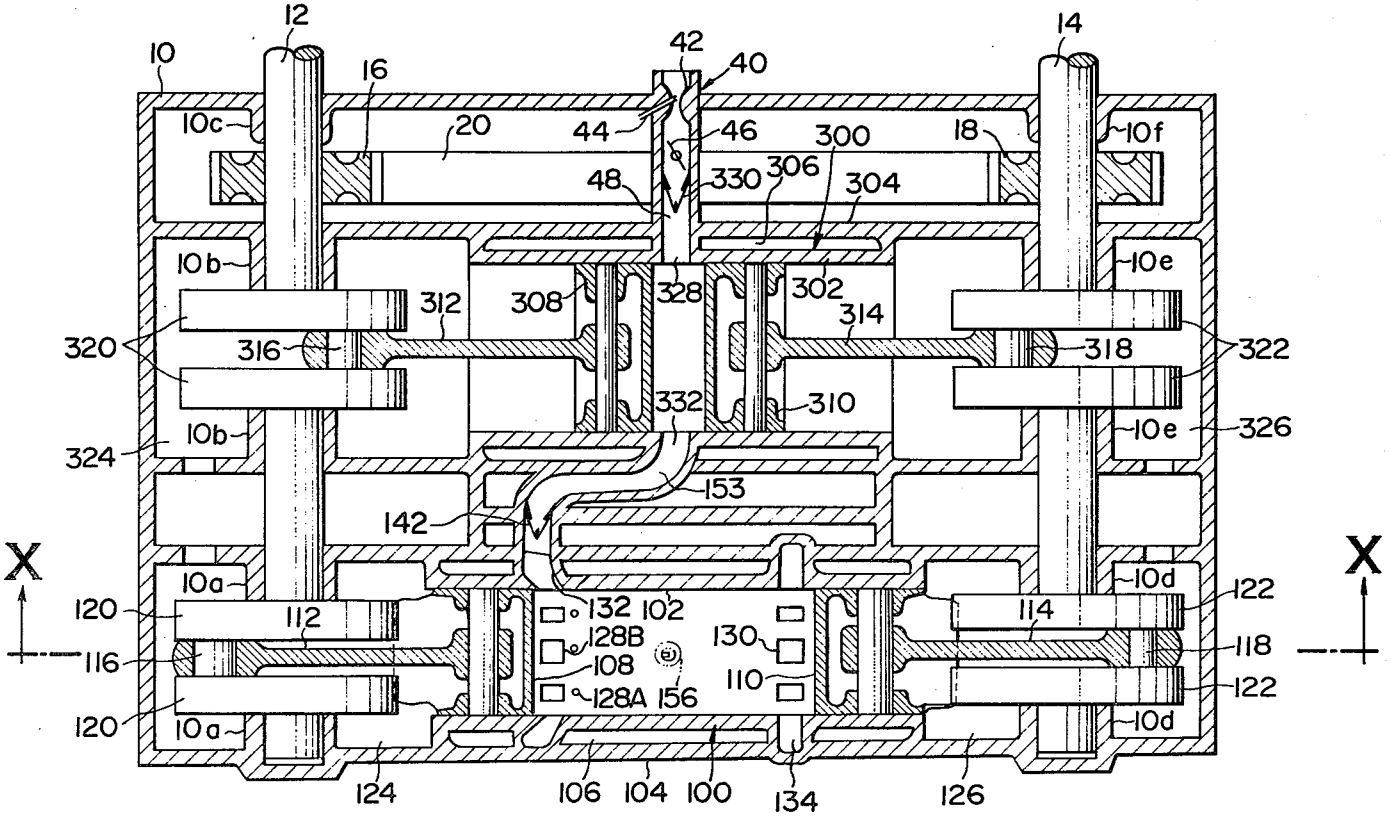
FIG. 9 is a diagrammatical view showing another embodiment of the two-stroke gasoline engine of the present invention, which is obtained by incorporating the concept of the present invention in a two-stroke cycle gasoline engine having a two-stroke cycle power cylinder-piston assembly which incorporates uniflow scavenging and two horizontally opposed pistons, as proposed in U.S. Pat. No. 4,185,596.
Figure 10:
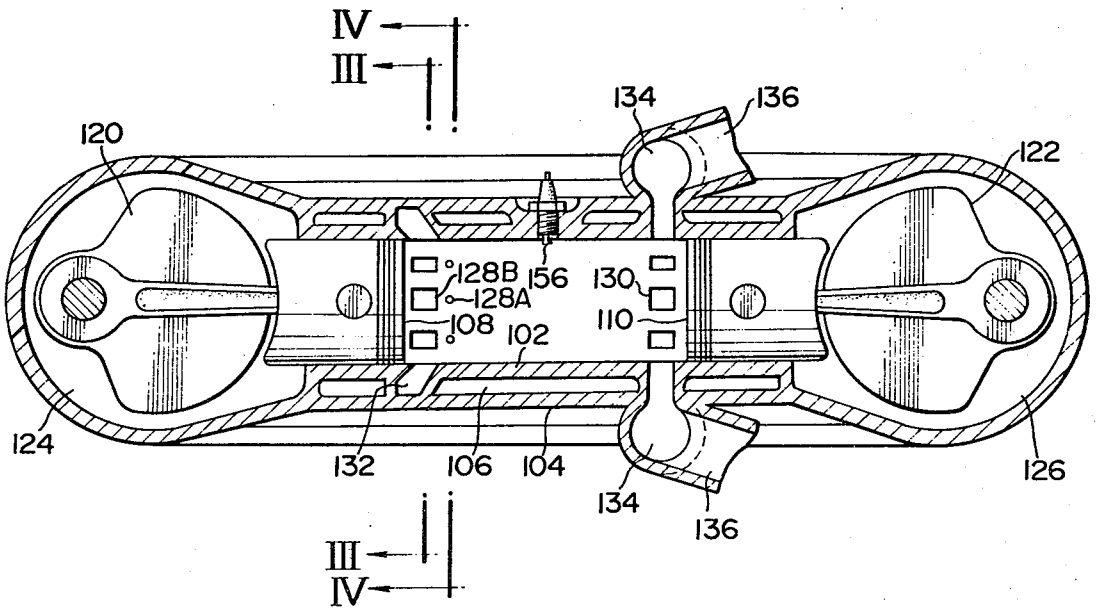
FIG. 10 is a sectional view along line X—X in FIG. IX.

FIG. 9 is a diagrammatical plan view showing another embodiment of the present invention, in which the concept of the present invention is incorporated in the two-stroke cycle gasoline engine which is shown in U.S. Pat. No. 4,185,596, which also includes a two-stroke cycle power cylinder-piston assembly incorporating uniflow scavenging and horizontally opposed pistons. FIG. 10 is a sectional view along line X—X in FIG. 9. Further, sections taken along lines III—III and IV—IV are substantially the same as the sections shown in FIGS. 3 and 4, respectively. In FIGS. 9 and 10, the portions corresponding to those shown in FIGS. 1 and 2 are designated by the same reference numerals as in FIGS. 1 and 2. When compared with the engine shown in FIGS. 1–4, the engine shown in FIGS. 9 and 10 is different in that crankcase compression is not employed, so that scavenging mixture is pressurized only by the pump cylinder-piston assembly 300, the total stroke volume of the pump cylinder-piston assembly is 1.15–1.65 times as large as that of the power cylinder-piston assembly 100, and the operational phase relation between the power cylinder-piston assembly 100 and the pump cylinder-piston assembly 300 is so determined that the top dead center of the pump cylinder-piston assembly is, as viewed in the crank angle diagram, in a range between 15° in advance of and 15° behind the midpoint between the bottom dead center and the scavenging port closing phase point of the power cylinder-piston assembly. In accordance with these differences in structure, the outlet of the carburetor 40 in the engine shown in FIGS. 9 and 10 is connected only to the inlet port 328 of the pump 300 by way of the passage 48, and the delivery port 332 of the pump 300 is directly connected to the scavenging plenum 132 by way of a passage 153.

Figure 11:
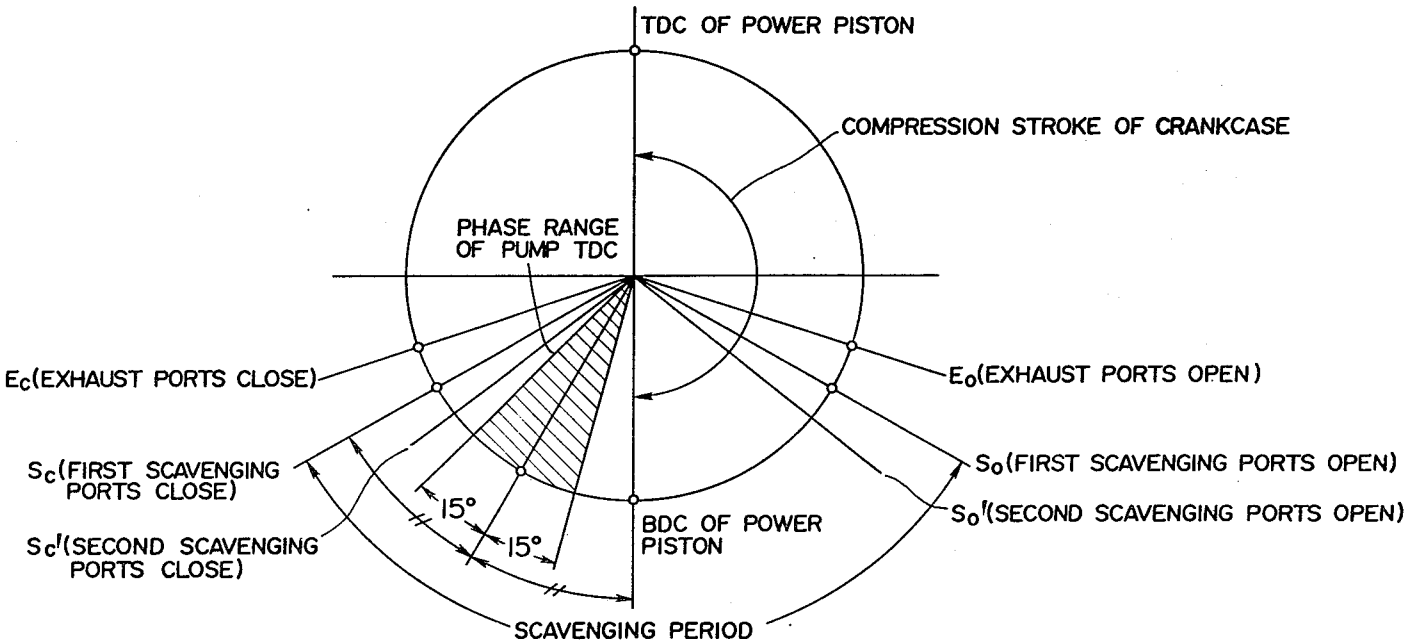
FIG. 11 is a crank angle diagram showing the operational phases of the engine shown in FIG. 10.
Figure 12:
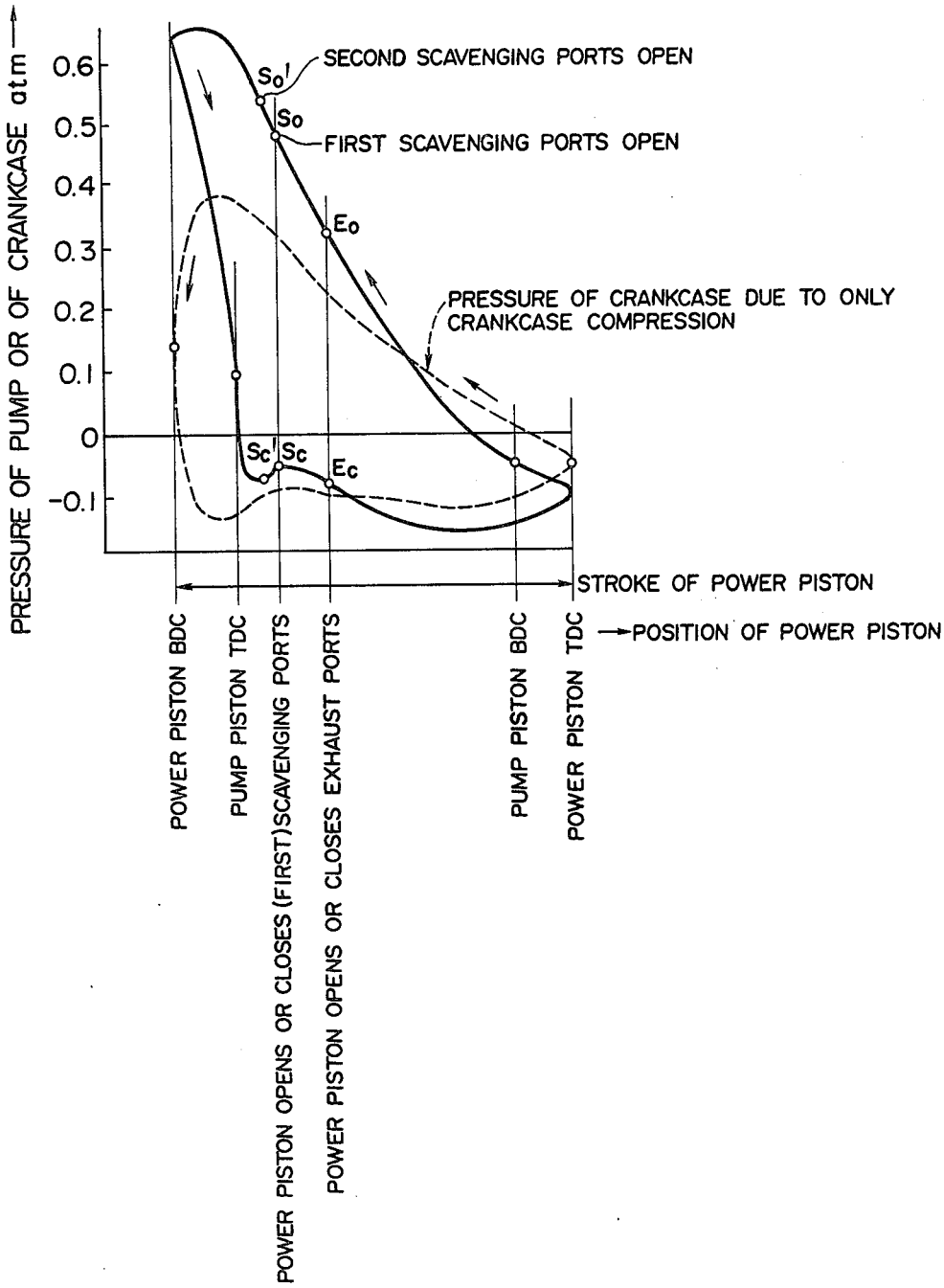
FIGS. 12 and 13 are indicator diagrams showing the pump pressure of the engine shown in FIGS. 9 and 10 in full throttle operation, and idling operation, respectively.
Figure 13:
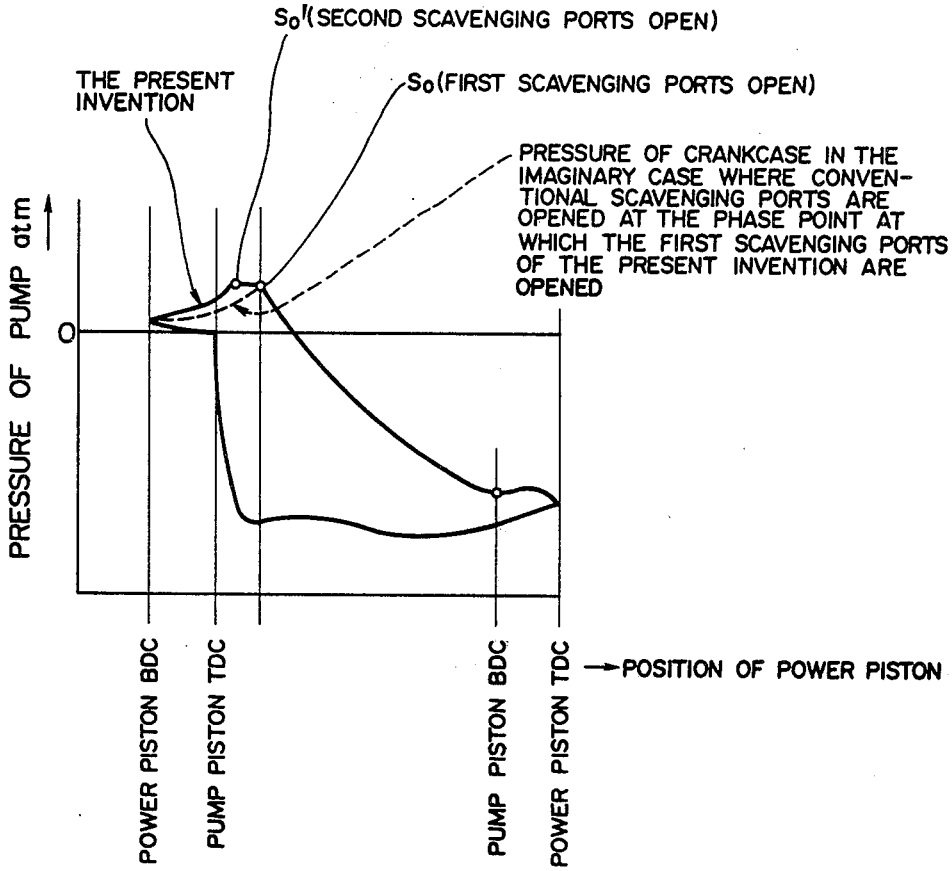

FIG. 11 is a crank angle diagram showing various operational phase of the engine shown in FIGS. 9 and 10. Further, FIG. 12 is an indicator diagram showing pressure performance of the pump 300 in full throttle operation of the engine which follows the crank angle diagram shown in FIG. 11. In FIG. 12, for the purpose of comparison, crankcase pressure performance in a conventional two-stroke cycle engine dependent upon only crankcase compression is also shown. FIG. 13 is an indicator diagram showing pump pressure performance of the engine shown in FIGS. 9 and 10 in idling operation thereof. Also in this case, as explaind with respect to FIG. 7 which shows pump pressure performance in idling operation of the engine shown in FIGS. 1–4, if the first scavenging ports 128A were not provided, the pump pressure would rapidly lower as shown by a broken line as the scavenging ports were opened by traversing of the power piston, whereas, when the scavenging ports are divided into groups of first and second scavenging ports in accordance with the present invention, the level of pump pressure available at the instant when the first scavenging ports are opened is maintained for a substantial period which lasts from the moment when the first scavenging ports start to open to the moment when the second scavenging ports start to open, thereby providing substantial continuing jets of scavenging mixture discharged from the first scavenging ports which generate a strong swirl flow in the power cylinder and improve ignitability and combustion speed of fuel-air mixture, particularly in idling and low load operation of the engine. As understood from the comparison of FIGS. 7 and 13, due to the fact that the pump BDC of the engine shown in FIGS. 9 and 10 is behind the power piston BDC by a substantial phase angle as shown in FIG. 11, the pump pressure in the engine shown in FIGS. 9 and 10 does not immediately lower to atmospheric when the power piston has passed its BDC, and only lowers to atmospheric after the pump piston has reached its TDC which is behind the power piston BDC by a substantial phase angle.

Thus it will be appreciated that by the simple structure of providing the first scavenging ports having a relatively small total opening area in addition to the main or second scavenging ports which have the relatively large total opening area which is required for medium through high load operation of the engine, with the first scavenging ports being opened in advance of the main or second scavenging ports, the present invention accomplishes the object of avoiding irregular combustion in idling and low load operation of two-stroke cycle gasoline engines, so as to improve the fuel consumption, to reduce emission of harmful uncombusted components and offensive odor in exhaust gases, and to reduce noise and vibration.

Although the invention has been shown and described with respect to some preferred embodiments thereof, it should be understood by those skilled in the art that various changes and omissions of the form and the detail thereof may be made therein without departing from the scope of the invention.

We claim:

1. A two-stroke cycle gasoline engine, comprising a power cylinder-piston assembly including a scavenging port configuration having a first scavenging port configuration disposed generally along a first common plane normal to the axis of the power cylinder first uncovered by the power piston as it moves along the power cylinder from is top dead center to its bottom dead center and a second scavenging port configuration disposed generally along a second common plane normal to the axis of the power cylinder uncovered by the power piston as it moves from its top dead center to its bottom dead center immediately after said power piston has completed uncovering the first scavenging port configuration, wherein the general rate relative to piston position in the power cylinder of uncovering the area of the first scavenging port configuration is several times smaller than that of the second scavenging port configuration, said first scavenging port configuration ejecting jet flows of scavenging mixture strong enough to generate turbulence in said power cylinder at an early stage of uncovering said scavenging port by said power piston even when said engine is at low load operation including idle, while said second scavenging port configuration provides openings large enough to complete scavenging of said power cylinder when said engine is at full load operation.

2. The engine of claim 1, wherein said power cylinder-piston assembly incorporates uniflow scavenging and two horizontally opposed pistons.

3. The engine of claim 1, wherein said engine comprises at least one two-stroke power cylinder-piston assembly incorporating uniflow scavenging and two horizontally opposed pistons as said power cylinder-piston assembly, and a scavenging pump means including at least one pump cylinder-piston assembly of the reciprocating type driven by said power cylinder-piston assembly in synchronization therewith, wherein the total stroke volume of said scavenging pump means is between 1.35 and 1.85 times as large as that of said power cylinder-piston assembly, and the operational phase of a pump cylinder-piston assembly is so shifted relative to that of the power cylinder-piston assembly to which it supplies scavenging mixture that, when the power cylinder-piston assembly is at its bottom dead center, the pump cylinder-piston assembly is in a range defined by at and slightly before its top dead center.

4. The engine of claim 1, wherein said engine comprises at least one two-stroke cycle power cylinder-piston assembly incorporating uniflow scavenging and two horizontally opposed pistons as said power cylinder-piston assembly, at least one scavenging pump cylinder-piston assembly of the reciprocating type and driven by said power cylinder-piston assembly in synchronization therewith with a phase difference, wherein the total stroke volume of said pump cylinder-piston assembly is between 1.15 and 1.65 times as large of that of said power cylinder-piston assembly, and said phase difference between said power and pump cylinder-piston assemblies is so determined that the top dead center of a pump cylinder-piston assembly is in a range or crank angle between 15° in advance of and 15° behind the midpoint between the bottom dead center and the scavenging port closing phase point of the power cylinder-piston assembly to which it supplies scavenging mixture.

5. The engine of any one of claims 1–4, wherein each of said first and second scavenging port configurations consists of at least one port aperture, and the first and second scavenging port configurations are separate from one another.

6. The engine of claim 5, wherein said port aperture of said second scavenging port configuration is a substantially parallelogram-shaped aperture with a pair of parallel edges being substantially circumferential to the power cylinder.

7. The engine of claim 6, wherein said parallelogram-shaped aperture has another pair of parallel edges which are substantially parallel to the axis of the power cylinder.

* * * * *

UNITED STATES PATENT AND TRADEMARK OFFICE

CERTIFICATE OF CORRECTION

PATENT NO. : 4,480,597

DATED : November 6, 1984

INVENTOR(S) : Masaaki Noguchi et al.

It is certified that error appears in the above—identified patent and that said Letters Patent is hereby corrected as shown below:

Claim 3, line 2, after "two-stroke" insert --cycle--.

Claim 4, line 14, change "or" to --of--.

Signed and Sealed this

*Fourth* Day of *June 1985*

[SEAL]

*Attest:*

DONALD J. QUIGG

*Attesting Officer* *Acting Commissioner of Patents and Trademarks*